US009158224B2

(12) United States Patent
Jung

(10) Patent No.: US 9,158,224 B2
(45) Date of Patent: Oct. 13, 2015

(54) IMAGE FORMING APPARATUS GENERATING HORIZONTAL SYNCHRONIZATION SIGNALS AND METHOD OF IMAGE FORMING

(71) Applicant: Samsung Electronics Co., Ltd, Suwon-si, Gyeonggi-do (KR)

(72) Inventor: Dong-sun Jung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 113 days.

(21) Appl. No.: 13/960,895

(22) Filed: Aug. 7, 2013

(65) Prior Publication Data

US 2014/0240430 A1 Aug. 28, 2014

(30) Foreign Application Priority Data

Feb. 22, 2013 (KR) ..... 10-2013-0019259

(51) Int. Cl.
*B41J 2/385* (2006.01)
*B41J 2/435* (2006.01)
*B41J 2/47* (2006.01)
*G03G 15/043* (2006.01)

(52) U.S. Cl.
CPC ..... *G03G 15/043* (2013.01)

(58) Field of Classification Search
USPC ..... 347/116, 229, 234–237, 246–250
See application file for complete search history.

(56) References Cited

U.S. PATENT DOCUMENTS

| | | | | |
|---|---|---|---|---|
| 6,069,645 | A * | 5/2000 | Vincent | 347/246 |
| 7,277,113 | B2 * | 10/2007 | Sobue et al. | 347/250 |
| 7,949,266 | B2 * | 5/2011 | Asakawa | 399/27 |
| 8,253,769 | B2 * | 8/2012 | Ono | 347/246 |

* cited by examiner

*Primary Examiner* — Hai C Pham
(74) *Attorney, Agent, or Firm* — Staas & Halsey LLP

(57) ABSTRACT

An image forming apparatus includes an image forming unit to perform printing using a light source unit and a photosensitive medium, a registration unit to adjust an exposure time to correspond to a change in a power of a light source when the power of the light source changes, and a controller to control the image forming unit to perform printing according to the adjusted exposure time.

17 Claims, 9 Drawing Sheets

FIG. 5

| | WHEN K IS CHANGED AND M IS FIXED | | | |
|---|---|---|---|---|
| K(V) | M(V) | K~M sync(us) | VARIATION(us) | Dot |
| 0.6 | 1 | 148.84476 | -0.01965 | -0.62 |
| 0.7 | 1 | 148.85163 | -0.01278 | -0.40 |
| 0.8 | 1 | 148.85657 | -0.00784 | -0.25 |
| 0.9 | 1 | 148.86424 | -0.00017 | -0.01 |
| 1 | 1 | 148.86441 | 0.00000 | 0.00 |
| 1.1 | 1 | 148.86758 | 0.00317 | 0.10 |
| 1.2 | 1 | 148.86979 | 0.00538 | 0.17 |
| 1.3 | 1 | 148.87185 | 0.00744 | 0.23 |
| 1.4 | 1 | 148.87200 | 0.00759 | 0.24 |
| 1.5 | 1 | 148.87244 | 0.00803 | 0.25 |
| 1.6 | 1 | 148.87341 | 0.00900 | 0.28 |
| 1.7 | 1 | 148.87275 | 0.00834 | 0.26 |
| 1.8 | 1 | 148.87249 | 0.00808 | 0.25 |
| 1.9 | 1 | 148.87412 | 0.00971 | 0.31 |
| 2 | 1 | 148.87573 | 0.01132 | 0.36 |
| | | | Devi. | 0.97 |

IMAGE FORMING APPARATUS GENERATING HORIZONTAL SYNCHRONIZATION SIGNALS AND METHOD OF IMAGE FORMING

CROSS-REFERENCE TO RELATED APPLICATIONS

This application claims priority under 35 U.S.C. §119 (a) from Korean Patent Application No. 10-2013-0019259, filed on Feb. 22, 2013, in the Korean Intellectual Property Office, the disclosure of which is incorporated herein by reference in its entirety.

BACKGROUND OF THE INVENTION

1. Field of the Invention

Apparatuses and methods consistent with the present general inventive concept relate to an image forming apparatus and method of image forming, and more particularly, to an image forming apparatus and method of image forming which are capable of compensating for a variation in an exposure time, caused by a change in the power of a light source.

2. Description of the Related Art

In general, an image forming apparatus using electrophotography, such as a laser printer, a copy machine, a multifunctional peripheral device, and a facsimile machine, includes an optical scanner. The image forming apparatus prints a desired image by forming an electrostatic latent image on a photosensitive medium by using a light beam output from the optical scanner, and transferring the electrostatic latent image onto paper.

An electrophotographic printer in the related art, such as a color laser printer, includes four photosensitive drums Dy, Dc, Dm, and Dk (not illustrated) prepared to correspond to four colors, e.g., yellow, cyan, magenta, and black, an exposure device that forms an electrostatic latent image of a desired image by scanning light on the photosensitive drums Dy, Dc, Dm, and Dk, a developing device that develops the electrostatic latent image using each of yellow, cyan, magenta, and black developing solutions, and an image forming medium (such as a transfer belt or an intermediate transfer belt) onto which developed images formed on the photosensitive drums Dy, Dc, Dm, and Dk are sequentially transferred to overlap with one another so as to form a complete color image, and via which the complete color image is then transferred onto paper.

Thus, in order to print a desired color image, an image is developed on the four photosensitive drums Dy, Dc, Dm, and Dk by using four colors, e.g., yellow, cyan, magenta, and black, respectively, and the developed images are transferred onto the same location on the image forming medium to overlap with one another so as to obtain a final color image. Then, the final color image is printed on paper.

However, in order to exactly form a desired color image by overlapping four colors on the same location on the image forming medium, all of locations on the respective four photosensitive drums Dy, Dc, Dm, and Dk on which transferring of images onto the image forming medium starts and ends should be the same for these four colors. This is because even if all of the images are clearly developed on the four photosensitive drums Dy, Dc, Dm, and Dk, a final color image obtained when locations on the image forming medium onto which these images are transferred do not coincide to even a small degree does not exactly exhibit the desired colors and image.

Thus, in order to exactly form a color image, it is important to precisely equalize points of time when the four photosensitive drums Dy, Dc, Dm, and Dk start to be exposed using the exposure device, in consideration of a time of driving the image forming medium. A process of equalizing such exposure start times such that a plurality of colors that are to be used to form one image exactly overlap with one another as described above is referred to as color registration.

However, conventionally, since a predetermined exposure start time is used even when the power of the light changes, a plurality of colors may not exactly overlap with one another even after color registration is performed.

Specifically, exposure start times of the respective photosensitive drums are determined based on a falling or rising edge of a horizontal synchronization signal. However, since a change in the power of the light may cause a change in the horizontal synchronization signal, a plurality of colors do not exactly overlap with one another when the rising or falling edge of the horizontal synchronization signal changes due to a change in the power of the light.

SUMMARY OF THE INVENTION

The present general inventive concept is directed to an image forming apparatus and method of image forming which are capable of compensating for a change in an exposure time, caused by a change in the power of a light source.

Additional features and utilities of the present general inventive concept will be set forth in part in the description which follows and, in part, will be obvious from the description, or may be learned by practice of the general inventive concept.

Exemplary embodiments of the present general inventive concept provide an image forming apparatus including an image forming unit to perform printing using a light source unit and a photosensitive medium, a registration unit to adjust an exposure time to correspond to a change in a power of a light source when the power of the light source changes, and a controller to control the image forming unit to perform printing according to the adjusted exposure time.

The image forming unit may generate a horizontal synchronization signal to determine the exposure time, and the registration unit may adjust the exposure time by sensing a variation in the horizontal synchronization signal according to a change in the power of the light source, and compensating for the sensed variation.

The registration unit may calculate a time difference between before the power of the light source changes and after the power of the light source changes, at a falling or rising edge of the horizontal synchronization signal, and adjust an exposure time corresponding to before the power of the light source changes.

The image forming unit may include the photosensitive medium, the light source unit, a polygon mirror to cause a light source output from the light source unit to be deflected toward the photosensitive medium by using a plurality of reflection surfaces, and a beam detection sensor which outputs a beam detection signal by sensing the light source reflected from the polygon mirror. The image forming unit may generate the horizontal synchronization signal based on the beam detection signal.

The image forming apparatus may further include a storage unit to store variations in a horizontal synchronization signal corresponding to a plurality of voltages applied to the light source unit, in the form of a lookup table. The registration unit may detect a variation in the horizontal synchronization signal corresponding to a voltage applied to the light source unit, based on the lookup table, and adjust the exposure time based on the detected variation in the horizontal synchronization signal.

The controller may sequentially apply different voltages to the light source unit, measure variations in the horizontal synchronization signal with respect to the different voltages, and store the measured variations in the storage unit.

The image forming unit may include a light source unit including a plurality of light sources, and a plurality of photosensitive media, the image forming unit generating a plurality of horizontal synchronization signals corresponding to the plurality of photosensitive media. The registration unit may change a power of a second light source that is different from a first light source while a power of the first light source is fixed among the plurality of light sources, and sense a change in a time difference between a first horizontal synchronization signal generated from the first light source and a second horizontal synchronization signal generated from the second light source with respect to a change in the power of the second light source, as a variation in the horizontal synchronization signal with respect to the change in the power of the second light source.

The controller may adjust the power of the light source of the light source unit to correspond to a concentration adjustment process performed to perform printing using a predetermined image concentration by the image forming unit.

The concentration adjustment process may be performed when at least one of temperature and humidity of an ambient environment of the image forming apparatus becomes equal to or greater than a predetermined level, when the image forming unit performs printing a number of times that is equal to or greater than a predetermined number of copies, when the photosensitive medium is replaced with another medium, or when the image forming unit does not perform printing for a predetermined time or more.

Exemplary embodiments of the present general inventive concept also provide an image forming method performed by an image forming apparatus, the method including sensing a change in a power of a light source of a light source unit, adjusting an exposure time to correspond to a change in the power of the light source when the power of the light source of the light source unit changes, and performing printing according to the adjusted exposure time.

The image forming method may further include generating a horizontal synchronization signal to determine the exposure time. The adjusting of the exposure time may include sensing a variation in the horizontal synchronization signal with respect to the change in the power of the light source, and adjusting the exposure time to compensate for the sensed variation.

The adjusting of the exposure time may include calculating a time difference between before the power of the light source changes and after the power of the light source changes, at a falling or rising edge of the horizontal synchronization signal, and adjusting an exposure time corresponding to before the power of the light source changes, based on the calculated time difference.

The adjusting of the exposure time may include detecting a variation in a horizontal synchronization signal corresponding to a voltage applied to the light source unit, based on a lookup table storing variations in the horizontal synchronization signal corresponding to a plurality of voltages applied to the light source unit, and adjusting the exposure time based on the detected variation in the horizontal synchronization signal.

The image forming method may further include generating a lookup table by sequentially applying different voltages to the light source unit and measuring variations in the horizontal synchronization signal with respect to the different voltages.

The image forming method may further include generating a plurality of horizontal synchronization signals corresponding to a plurality of light sources and a plurality of photosensitive media. The generating of the lookup table may include changing a power of a second light source that is different from a first light source while power of the first light source is fixed among the plurality of light sources, and sensing a change in a time difference between a first horizontal synchronization signal generated from the first light source and a second horizontal synchronization signal generated from the second light source with respect to a change in the power of the second light source, as a variation in the horizontal synchronization signal with respect to the change in the power of the second light source.

The sensing of the change in the power of the light source may include sensing that the power of the light source changes when a concentration adjustment process is performed to perform printing using a predetermined image concentration by the image forming unit.

The concentration adjustment process may be performed when at least one of temperature and humidity of an ambient environment of the image forming apparatus becomes equal to or greater than a predetermined level, when the image forming unit performs printing a number of times that is equal to or greater than a predetermined number of copies, when the photosensitive medium is replaced with another medium, or when the image forming unit does not perform printing for a predetermined time or more.

A non-transitory computer readable recording medium may contain computer-readable codes as a program to execute the image forming method performed by the image forming apparatus.

Exemplary embodiments of the present general inventive concept also provide an image forming apparatus including a light source to generate light incident on a photosensitive drum, and a controller to control an exposure time of the light of the light source unit and a rotation timing of the photosensitive drum according to a power change of the light source unit.

The controller may detect the power change of the light source unit when concentration correction is performed to perform printing according to a predetermined image concentration.

The controller may detect the power change of the light source unit by detecting a change in an operating voltage of the light source unit.

The image forming apparatus may further include a storage unit to store a lookup table, the lookup table including information on exposure times of the photosensitive drum based on the power change of the light source unit. The controller may adjust the exposure time according to the lookup table.

The controller may generate the lookup table by testing variations in a horizontal synchronization signal according to the power change of the light source unit.

The image forming apparatus may further include a plurality of light source units, each light source unit providing a separate light. The lookup table may reflect variations in a horizontal synchronization signal of one of the plurality of lights according to power changes of the corresponding light source unit while the power of another of the plurality of light source units is held constant.

Exemplary embodiments of the present general inventive concept also provide an image forming method including providing a light source unit to generate a light incident on a photosensitive drum, and controlling an exposure time of the light and a rotation timing of the photosensitive drum according to a power change of the light source unit.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 5 is a lookup table consistent with an exemplary embodiment of the present general inventive concept;

DETAILED DESCRIPTION OF THE EMBODIMENTS

Figure 1:
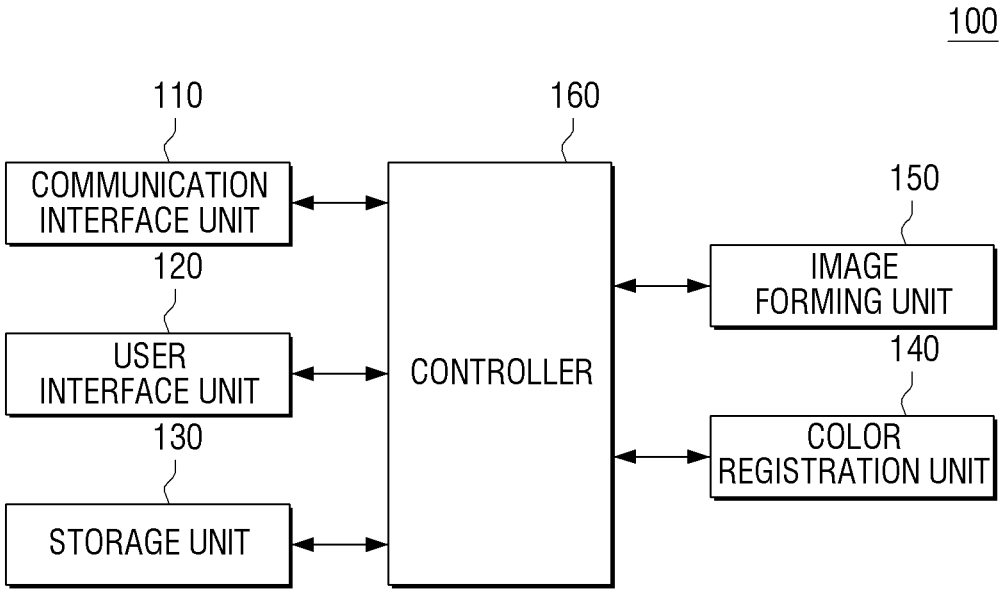
FIG. 1 is a block diagram illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined in the description, such as detailed construction and elements, are provided to assist in a comprehensive understanding of the present general inventive concept. Thus, it is apparent that the exemplary embodiments of the present general inventive concept can be carried out without those specifically defined matters. Also, well-known functions or constructions are not described in detail since they would obscure the present general inventive concept with unnecessary detail.

FIG. 1 is a block diagram of an image forming apparatus 100 according to an exemplary embodiment of the present general inventive concept.

Referring to FIG. 1, the image forming apparatus 100 includes a communication interface unit 110, a user interface unit 120, a storage unit 130, a color registration unit 140, an image forming unit 150, and a controller 160.

The communication interface unit 110 is connected to a print control terminal device (not illustrated), such as a personal computer (PC), a notebook PC, a personal digital assistant (PDA), a digital camera, or the like. Specifically, the communication interface unit 110 is formed to connect the image forming apparatus 100 to an external device (not illustrated). The communication interface unit 110 may be connected to the print control terminal device via not only a local area network (LAN) or the Internet but also a universal serial bus (USB) port. Also, the communication interface unit 110 may be connected to the print control terminal device in not only a wired manner but also a wireless manner.

The communication interface unit 110 may receive print data from the print control terminal device. Also, the communication interface unit 110 may receive a command from the print control terminal device instructing to perform color registration.

The user interface unit 120 includes a plurality of function keys (not illustrated) via which a user may set or select various functions supported by the image forming apparatus 100, and displays various information provided from the image forming apparatus 100. The user interface unit 130 may be embodied as a device (e.g., a touch screen) via which both a data input operation and a data output operation are performed, or may be embodied as a device formed by combining a mouse and a monitor (not illustrated). A user may input a command instructing to perform color registration on the image the forming apparatus 100 by using a user interface window (not illustrated) provided via the user interface unit 130.

The storage unit 130 may store print data. Specifically, the storage unit 130 may store print data received via the communication interface unit 110. Also, the storage unit 130 may store history information of a print job performed by the image forming apparatus 100. Also, the storage unit 130 may store variations in a horizontal synchronization signal corresponding to a plurality of voltages applied to a light source unit (151, illustrated in FIG. 2), in the form of a lookup table. The lookup table may be initially provided by a manufacturer or may be produced through an operation of the controller 160, as which will be described below.

The storage unit 130 may be embodied as a storage medium included in the image forming apparatus 100, an external storage medium, e.g., a removable disk such as a USB memory, or a web server using a network.

The color registration unit 140 may form a registration pattern on an image forming medium (particularly, a transfer belt or an intermediate transfer belt), and may determine exposure start times of respective photosensitive drums Dy, Dc, Dm, and Dk, based on the registration pattern. This process may be performed when the image forming unit 150 includes a plurality of photosensitive drums (158, illustrated in FIG. 2). When the image forming unit 150 includes one photosensitive drum 158, an exposure start time of the photosensitive drum 158 may be determined.

The light source unit 151 provides a light source. For the purposes of the exemplary embodiments of the present general inventive concept, a "light source" may include a light emitted from the light source unit, and is not limited to a physical construct. Furthermore, a power of the light source may refer to a voltage measured at the light source unit 151, or may refer to characteristic of the light source, such as an intensity or an amount of light. The power of the light source may change due to a power of the light source unit 151 changing. The power of the light source unit 151 may change due to a change in power being supplied to the light source unit 151, or to an internal change in the light source unit 151.

When the power of a light source of the light source unit 151 changes, the color registration unit 140 adjusts an exposure start time to correspond to the changed power. Specifically, the color registration unit 140 may sense a variation in a horizontal synchronization signal, caused by the change in the power of the light source, and adjust the exposure start time by compensating for the sensed variation in the horizontal synchronization signal. More specifically, the color registration unit 140 may calculate a time difference between before the power of the light source does not change and after the power of the light source changes, at a rising or falling edge of the horizontal synchronization signal, and may adjust an exposure time corresponding to before the power of light source changes, based on the calculated time difference. The operation of the color registration unit 140 will be described in detail with reference to FIG. 7 below. In this case, when the image forming unit 150 includes a plurality of photosensitive drums 158, the color registration unit 140 may adjust exposure start times of the plurality of photosensitive drums 158 according to changes in the powers of a plurality of light sources, respectively.

The photosensitive drum 158 rotates according to a rotation timing while it is being exposed to the light source, so that the light source may be exposed to the entire surface of the photosensitive drum 158. In the exemplary embodiments of the present general inventive concept, the exposure time of the photosensitive drum 158 may be adjusted by changing the rotation timing of the photosensitive drum 158.

The image forming unit 150 performs printing using the light source unit 151 and a photosensitive medium 158, which may be a photosensitive drum. A structure and operation of the image forming unit 150 will be described in detail with reference to FIG. 2 below.

The controller 160 controls the elements of the image forming apparatus 100. Specifically, when the controller 160 receives print data from the print control terminal device, the controller 160 may control the image forming unit 150 to print the print data.

Also, the controller 160 may determine whether color registration needs to be performed. Specifically, the controller 160 may determine that color registration needs to be performed when the image forming apparatus 100 performs printing a predetermined number of prints, based on history information stored in the storage unit 130, or when a command instructing to perform color registration is input from the print control terminal device or the user interface unit 130. Alternatively, the present general inventive concept may be embodied such that the process described above is performed when concentration correction needs to be performed.

When it is determined that color registration needs to be performed, the controller 160 may control the color registration unit 140 to perform color registration.

Also, the controller 160 senses whether the power of a light source changes. Specifically, the controller 160 may sense that the power of the light source changes when concentration correction is performed to perform printing according to a predetermined image concentration. The concentration correction may be performed when at least one of a temperature and a humidity of an ambient environment of the image forming apparatus 100 becomes equal to or greater than a predetermined level, when the image forming unit 150 performs printing a number of times that is equal to or greater than the predetermined number of copies, when the photosensitive medium is replaced with another medium, or when the image forming unit 150 does not perform printing for a predetermined time or more. Although it is described in the present exemplary embodiment of the present general inventive concept that a change in the power of the light source is indirectly sensed, the present general inventive concept may be embodied such that the controller 160 senses a change in the power of the light source by directly sensing an operating voltage of the light source unit 151.

When it is determined that the power of the light source changes, the controller 160 may control the color registration unit 140 to adjust an exposure time to correspond to the changed power of the light source. Although it is determined in the current exemplary embodiment of the present general inventive concept that the color registration unit 140 adjusts the exposure time to correspond to the power of the light source, the image forming unit 150 or the controller 160 may adjust the exposure time to correspond to the power of light source.

The controller 160 may produce a lookup table. Specifically, the controller 160 may produce a lookup table by sequentially applying different voltages to the light source unit 151 and measuring variations in the horizontal synchronization signal according to the different voltages, when a lookup table storing variations in the horizontal synchronization signal according to voltages of the light source is not stored in the storage unit 130 or when a lookup table was produced before a predetermined point of time. Also, the controller 160 may store the produced lookup table in the storage unit 130. A method of producing a lookup table will be described in detail with reference to FIGS. 4 and 5 below.

As described above, the image forming apparatus 100 according to the present exemplary embodiment of the present general inventive concept is capable of adjusting an exposure time according to the power of a light source even when the power of the light source changes, thereby enabling a plurality of colors, which are to be used to form one image, to be printed such that the plurality of colors exactly overlap with one another.

Figure 2:
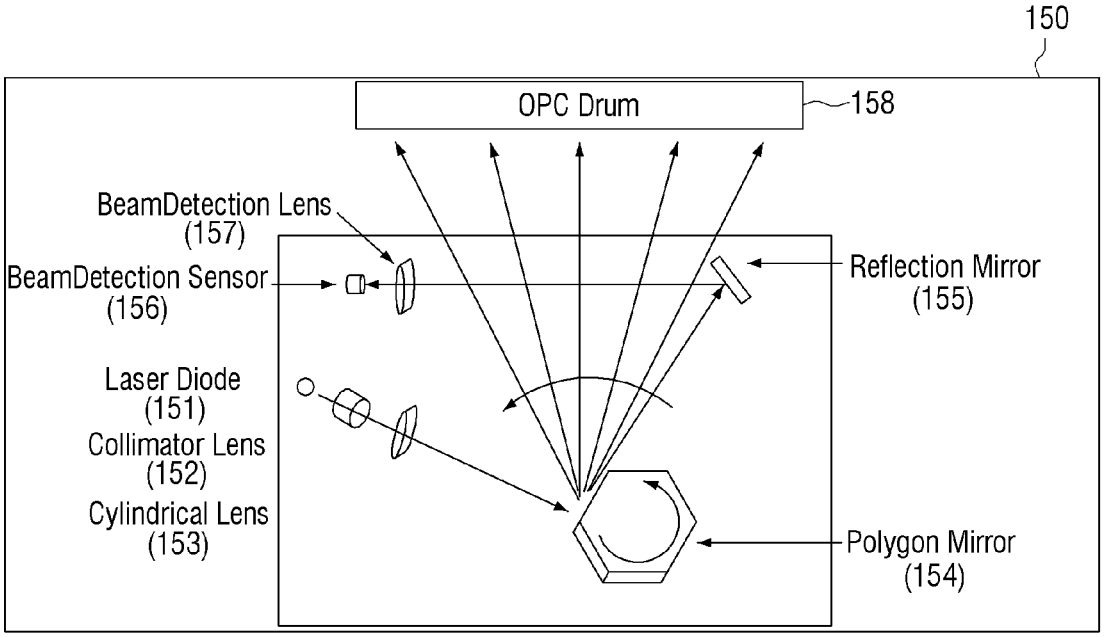
FIG. 2 is a diagram specifically illustrating the structure of an image forming unit of the exemplary embodiment of the present general inventive concept illustrated in FIG. 1.

FIG. 2 is a diagram specifically illustrating the structure of the image forming unit 150 of FIG. 1.

The image forming unit 150 is configured to form an electrostatic latent image on a photosensitive medium 158 by using a light beam output from a light source, and transfer the electrostatic latent image onto paper so as to print a desired image.

Specifically, the image forming unit 150 may include a light source unit (laser diode) 151, lens units 152, 153, and 157, a polygon mirror 154, a reflection mirror 155, a beam detection sensor 156, and a photosensitive medium 158. Although for convenience of explanation, it is described in the present exemplary embodiment of the present general inventive concept that the image forming unit 150 includes one light source unit 151 and one photosensitive medium 158, the image forming unit 150 may include a plurality of light sources and a plurality of photosensitive media when the image forming apparatus 100 is a color copy machine or a color printer capable of performing color printing.

According to the exemplary embodiment of the present general inventive concept as illustrated in FIG. 2, a laser diode 151 is configured as the light source unit 151 to generate and output a light beam. In general, a semiconductor diode is used as the laser diode 151.

The lens units 152, 153, and 157 enable the light beam output from the laser diode 151 to be exactly focused on the photosensitive medium 158 or the beam detection sensor 156.

The polygon mirror 154 causes the light beam output from the laser diode 151 to be deflected toward the photosensitive medium 158 by using a plurality of reflection surfaces thereof. Specifically, the light beam output from the laser diode 151 is reflected along a predetermined scanning path from the reflection surfaces of the polygon mirror 154 that rotates. Here, the scanning path means a path in which the light beam output from the laser diode 151 is reflected and travels.

The polygon mirror 154 includes square reflection surfaces having angles of 90 degrees, and a motor that rotates the polygon mirror 154 at a regular speed.

The reflection mirror 155 reflects a light beam, which is reflected from the polygon mirror 154 at a predetermined angle, to the beam detection sensor 156.

The beam detection sensor 156 outputs a bean detection signal by receiving a light beam that is output from the laser diode 151 and is reflected and focused during the rotation of the polygon mirror 154. Specifically, the beam detection sensor 156 may be disposed on a predetermined location to detect a beam output from the laser diode 151 and reflected from the polygon mirror 154 and the reflection mirror 155 at a predetermined angle by using an optical sensor included therein, and output a beam detection signal. The beam detection sensor 156 may be referred to as a BD sensor 156.

An electrostatic latent image is formed on the photosensitive medium 158 by scanning a beam reflected from the polygon mirror 154 onto the photosensitive medium 158, a developing solution is applied onto the electrostatic latent image, and the resultant electrostatic latent image is transferred onto paper (not illustrated) to print a desired image. The photosensitive medium 158 may be a photosensitive drum which is a drum type medium. In the case of a color printer, the photosensitive medium 158 may include a plurality of photosensitive media corresponding to black, cyan, magenta, and yellow to form a color image.

There is a section in which an image is formed by scanning a beam on the photosensitive medium 158, i.e., an effective scan width. To form the effective scan width at a constant level, a horizontal synchronization signal may be used. Here, the horizontal synchronization signal is generated based on the beam detection signal generated by the beam detection sensor 156. When the image forming unit 150 includes a plurality of light sources, the image forming unit 150 may generate a plurality of horizontal synchronization signals to correspond to the plurality of light sources, respectively. The image forming unit 150 may be embodied to classify a plurality of light sources into several groups and generate horizontal synchronization signals to correspond to the groups, respectively.

Although only some elements of the image forming unit 150 corresponding to an exposure device are illustrated in and described with reference to FIG. 2, the image forming unit 150 may further include a developing device and an image forming medium (not illustrated).

Figure 3:
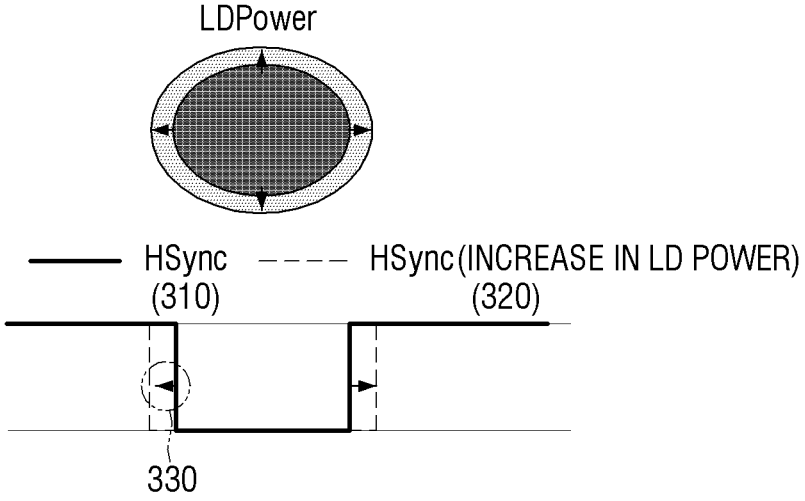
FIG. 3 is a diagram illustrating a change in a horizontal synchronization signal, caused by a change in the power of a light source, according to an exemplary embodiment of the present general inventive concept.

FIG. 3 is a diagram illustrating a variation in a horizontal synchronization signal, caused by a change in the power of a light source according to an exemplary embodiment of the present general inventive concept.

Referring to FIG. 3, it is noted that a change in the power of the light source causes a change in the size of a beam.

When the change in the power of the light source causes the change in the size of the beam, the beam detection sensor 156 receives the beam reflected during rotation of the polygon mirror 154 at a point of time different from a previous point of time.

Since the beam detection sensor 156 generates a beam detection signal at a point of time when a beam is received, points of time when edges of a horizontal synchronization signal change according to a change in the power of the light source.

For example, when the power of the light source increases, the beam detection sensor 156 may receive a beam earlier than as usual. Thus, a falling edge of the horizontal synchronization signal occurs earlier than before the power of the light source increases, and a rising edge of the horizontal synchronization signal occurs later than before the power of the light source increases, as illustrated in FIG. 3.

Problems caused when the horizontal synchronization signal changes and a method of solving these problems will now be described with reference to FIG. 4.

Figure 4:
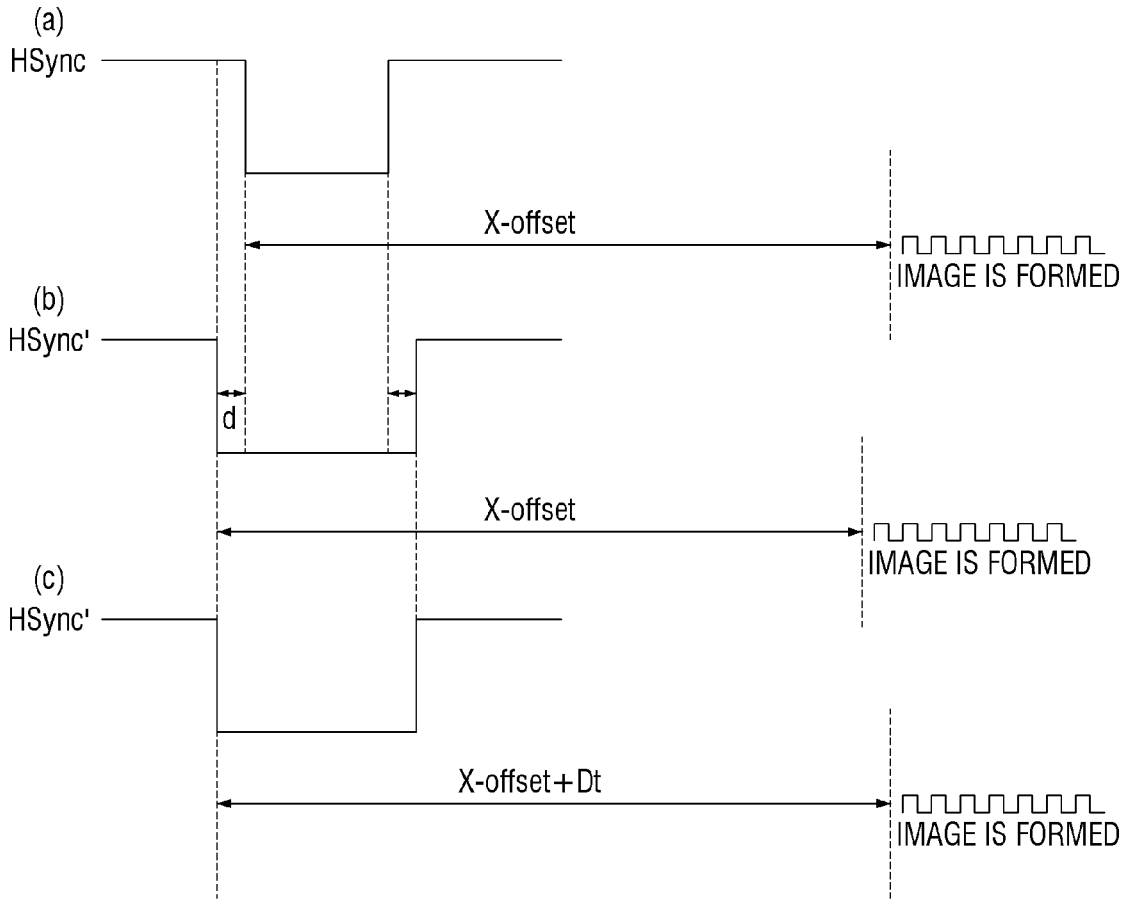
FIG. 4 is a timing diagram illustrating a process of adjusting an exposure time based on a variation in a measured horizontal synchronization signal according to an exemplary embodiment of the present general inventive concept.

FIG. 4 is a timing diagram illustrating a process of adjusting an exposure time based on a variation in a horizontal synchronization signal measured according to an exemplary embodiment of the present general inventive concept. Specifically, view (a) of FIG. 4 illustrates a normal horizontal synchronization time and an exposure time according thereto, view (b) of FIG. 4 illustrates a horizontal synchronization time changed due to a change in the power of a light source and an exposure time according thereto, and view (c) of FIG. 4 illustrates a horizontal synchronization time changed due to a change in the power of the light source and an exposure time when the change in the power of the light source is compensated for.

Referring to view (a) of FIG. 4, the color registration unit 140 calculates an X-offset value (i.e., an exposure time) according to a result of operating color registration beforehand. Here, the X-offset value is information indicating a point of time when exposure is to be performed after a falling edge of the horizontal synchronization signal. Thus, the image forming unit 150 may perform exposure when the X-offset value is greater than a predetermined value after the falling edge of the horizontal synchronization signal.

Referring to view (b) of FIG. 4, when the power of the light source is increased through concentration correction or the like, a falling edge of the horizontal synchronization signal occurs earlier than as usual. However, since the image forming unit 150 performs exposure when the X-offset value is greater than the predetermine value after the falling edge of the horizontal synchronization signal, exposure is performed earlier than in a normal case. This is illustrated in view (b) of FIG. 4 by the distance d by which the falling edge of the horizontal synchronization signal is shifted. Thus, a plurality of colors cannot exactly overlap with one another.

Referring to view (c) of FIG. 4, when the power of the light source is increased through concentration correction or the like, a falling edge of the horizontal synchronization signal occurs earlier than as usual. However, when an X-offset value is compensated for by using a variation Dt in the horizontal synchronization signal, caused by an increase in the power of the light source, exposure may be performed at a normal exposure time. This is illustrated in view (c) of FIG. 4 by the addition of Dt to the X-offset.

Thus, according to the present exemplary embodiment of the present general inventive concept, when the power of the light source changes, an exposure time is adjusted based on a variation in the horizontal synchronization signal, caused by the change in the power of the light source.

An exposure time may be adjusted by directly measuring a variation in the horizontal synchronization signal when the power of the light source changes, as described above, but may be adjusted using a lookup table that is measured and stored beforehand. A lookup table according to an exemplary embodiment of the present general inventive concept will be described with reference to FIG. 5 below.

FIG. 5 is a lookup table according to an exemplary embodiment of the present general inventive concept.

Referring to FIG. 5, the lookup table illustrated therein is directed to a situation in which the power of the light source associated with the black color (K) is changed and the power of the light source associated with the magenta color (M) is fixed, but it will be understood that a lookup table according to exemplary embodiments of the present general inventive concept may be directed to any variation of a color in the image forming apparatus 100. The lookup table according to the current exemplary embodiment of the present general inventive concept stores variations in a horizontal synchronization signal that correspond to a plurality of voltages applied to a light source unit 151, respectively. Here, the variations in the horizontal synchronization signal may be time values or distance values (dots). Although the exemplary embodiment of the present general inventive concept illustrated in FIG. 5 only illustrates the distance values in the lookup table, the present general inventive concept may be embodied such that the lookup table stores the time values, the distance values, or both the time and the distance values.

The lookup table may be provided from a manufacturer or may be directly produced by the image forming apparatus 100. A process of producing the lookup table will be described in detail with reference to FIGS. 7 and 8 below.

Although the lookup table may be produced and provided by a manufacturer, the lookup table is preferably directly produced by the image forming apparatus 100, as will be described with reference to FIG. 6 below.

Figure 6:
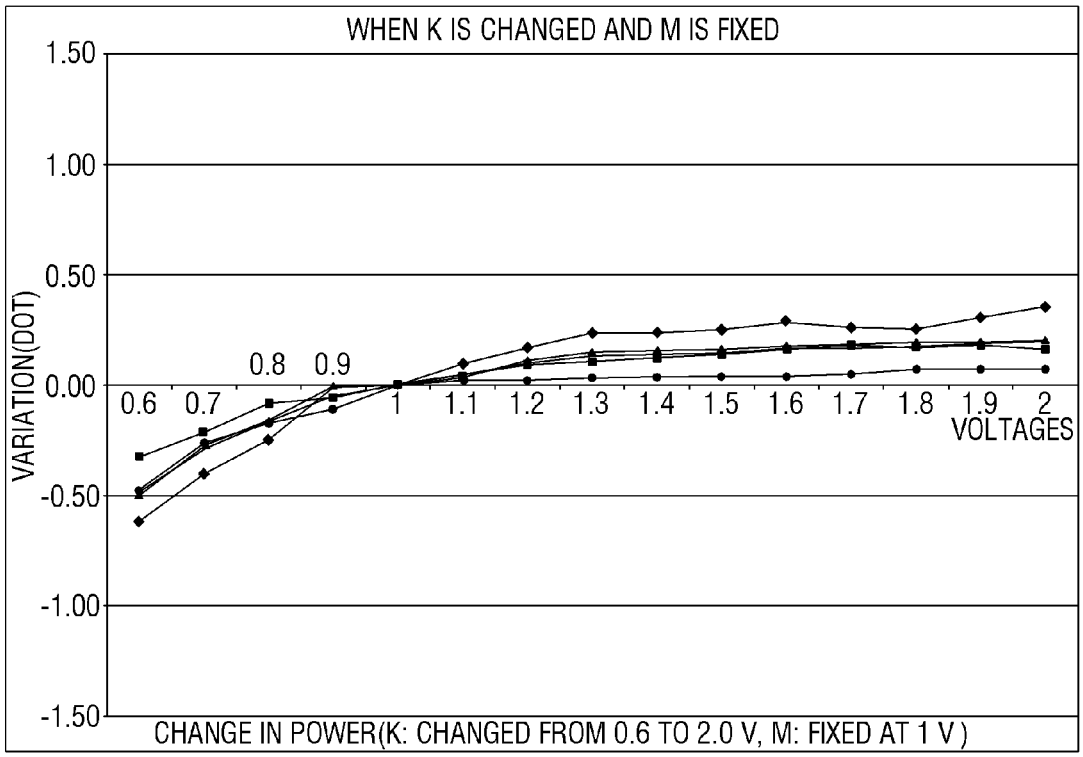
FIG. 6 is a graph illustrating errors occurring in a plurality of image forming apparatuses of the same type according to a change in the power of light source according to an exemplary embodiment of the present general inventive concept.

FIG. 6 is a graph illustrating errors occurring in a plurality of image forming apparatuses of the same type according to a change in the power of a light source.

Referring to FIG. 6, similarly to FIG. 5, the graph illustrated therein is directed to a situation in which the power of the light source associated with K is changed and the power of the light source associated with M is fixed, but it will be understood that exemplary embodiments of the present general inventive concept may be directed to any variation of a color in the image forming apparatus 100. As illustrated in FIG. 6, when the power of K is the same as the power of M, there is no variation, i.e. the variation (in dots, from FIG. 5) is at 0.0. FIG. 6 also illustrates that a change in the power of the light source causes a change in a location on an image forming apparatus onto which an image is transferred. That is, the variation goes up or down from 0.0, according to the change in the power of the light source. Thus, the image transfer location may be corrected by adjusting an exposure time based on a change in the power of the light source, according to the present exemplary embodiment of the present general inventive concept.

However, it is noted that even if the plurality of image forming apparatuses are the same type of apparatuses, image transfer locations on the plurality of image forming apparatuses are different with respect to a change in the power of the light source. Specifically, since the characteristics of light sources that are respectively installed in the plurality of image forming apparatuses are slightly different, an exposure time may not be adjusted appropriately in a desired image forming apparatus when the exposure time is adjusted using a lookup table provided from a manufacturer.

Accordingly, it is preferable that the image forming apparatus 100 actually tests variations in a horizontal synchronization signal according to a change in the power of a light source and stores a result of testing the variations in the form of a lookup table.

Figure 7:
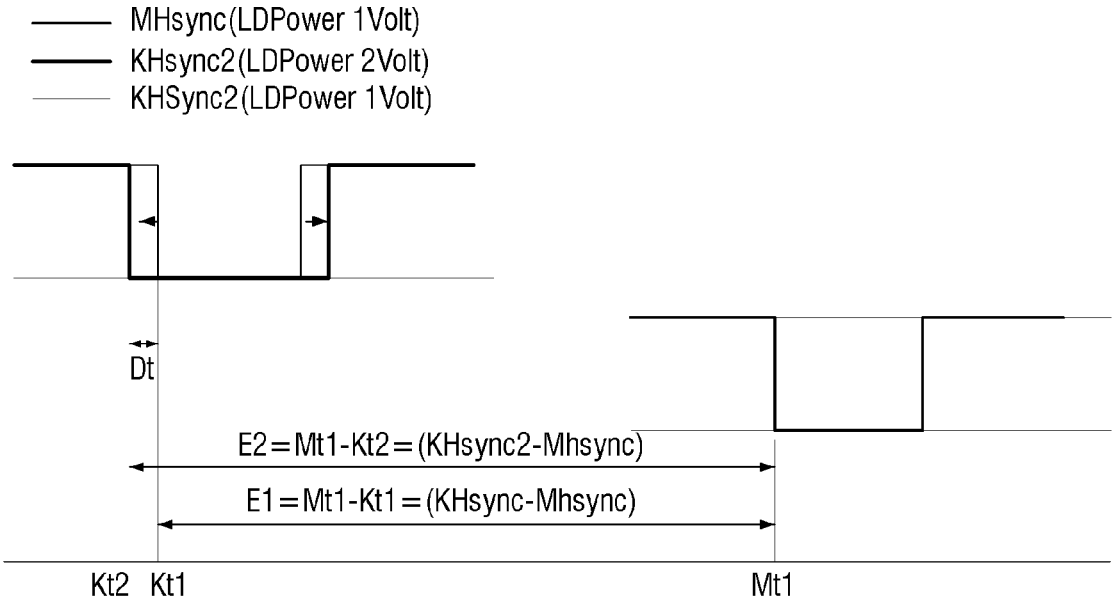
FIGS. 7 and 8 are diagrams illustrating methods of measuring a variation in a horizontal synchronization signal, consistent with exemplary embodiments of the present general inventive concept.
Figure 8:
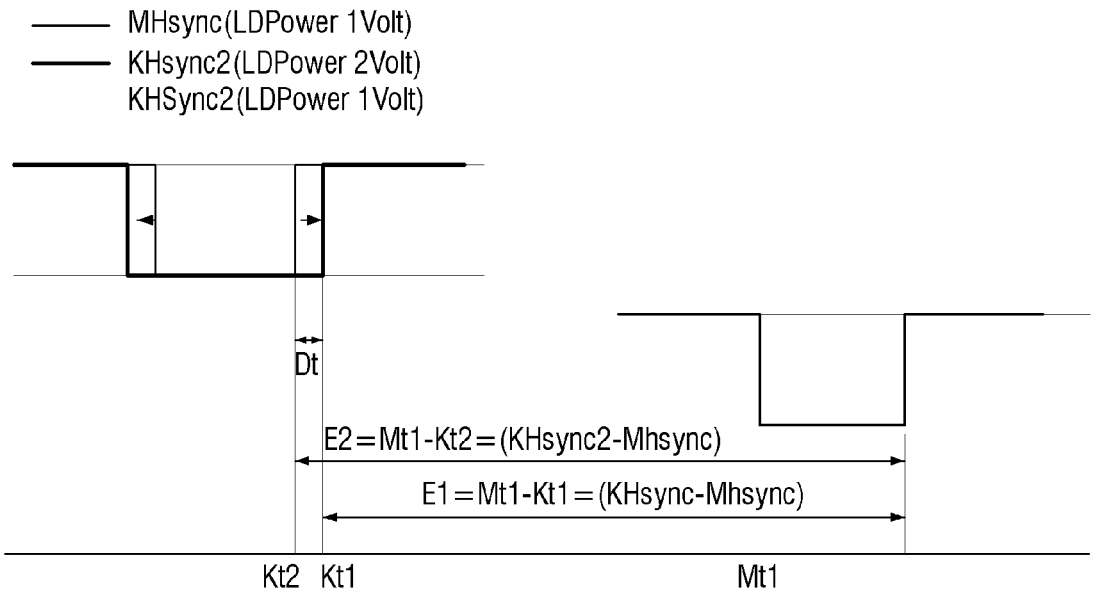

FIGS. 7 and 8 are diagrams illustrating methods of measuring a variation in a horizontal synchronization signal according to exemplary embodiments of the present general inventive concept. Specifically, FIG. 7 illustrates a method of measuring a variation in a horizontal synchronization signal when an exposure time is determined using a falling edge of the horizontal synchronization signal. FIG. 8 illustrates a method of measuring a variation in a horizontal synchronization signal when an exposure time is determined using a rising edge of the horizontal synchronization signal.

Referring to FIG. 7, among a plurality of light sources, the power of a first light source (a magenta light emitted from a magenta laser diode (LD)) is fixed to 1 V, and a second light source (a black light emitted from a black LD) that is different from the first light source is scanned at 1V. In this case, if a point of time when the power of the first light source is 1V is Mt1 and a point of time when the power of the second light source is 1V is Kt1, the difference (E1) between the point of time Mt1 and the point of time Kt1 is (Mt1-Kt1).

Then, if the power of the second light source is changed, for example from 1V to 2V and a point of time when the power of the second light source is 2V is Kt2, the difference (E2) between the point of time Mt1 and the point of time Kt2 is (Mt1-Kt2).

A variation in the horizontal synchronization signal with respect to a change in the power of the second light source may be calculated using the differences E1 and E2. By repeatedly performing this process, variations in the horizontal synchronization signal with respect to a plurality of voltages of the second light source may be calculated and stored in the form of a lookup table as illustrated in FIG. 5.

Referring to FIG. 8, among a plurality of light sources, the power of a first source (magenta light from a magenta LD) is fixed to 1V, and a second light source (black light from a black LD) that is different form the first light source is scanned at 1V. In this case, if a point of time when the power of the first power source is 1V is Mt1 and a point of time when the power of the second source is 1V is Kt1, the difference (E1) between these points of time is (Mt1-Kt1).

Then, if the power of the second light source is changed, for example, from 1V to 2V and a point of time when the power of the second source is 2V is Kt2, the difference E2 between these points of time is (Mt1-Kt2).

A variation in the horizontal synchronization signal with respect to a variation in the power of the second source may be calculated using the differences E1 and E2. By repeatedly performing this process, variations in the horizontal synchronization signal with respect to a plurality of voltages of the second light source may be calculated, and stored in the form of the lookup table as illustrated in FIG. 5.

Figure 9:
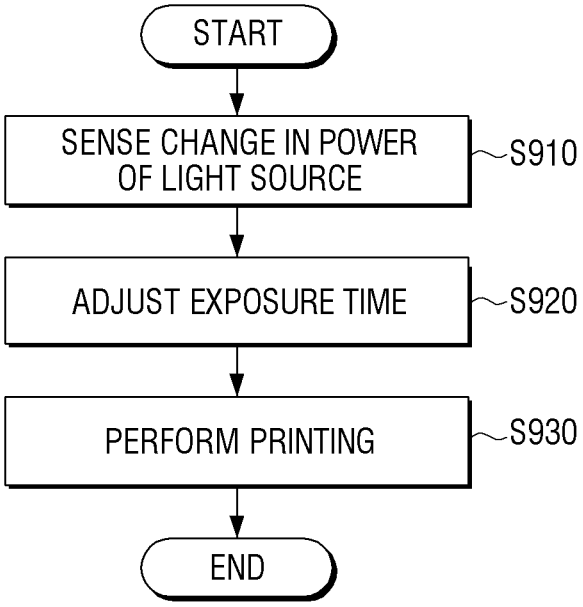
FIG. 9 is a flowchart illustrating a registration method consistent with an exemplary embodiment of the present general inventive concept.

FIG. 9 is a flowchart illustrating a registration method according to an exemplary embodiment of the present general inventive concept.

Referring to FIG. 9, first, a change in the power of a light source of a light source unit 151 is sensed (operation S910). Specifically, when an image forming unit 150 performs concentration correction to perform printing using a predetermined image concentration, it is sensed that the power of the light source is adjusted. Here, the concentration correction may be performed when at least one of temperature and humidity of an ambient environment of the image forming apparatus 100 becomes equal to or greater than a predetermined level, when the image forming unit 150 performs a number of times that is equal to or greater than a predetermined number of copies, when a photosensitive medium 158 is replaced with another medium, or when the image forming unit 150 does not perform printing for a predetermined time or more.

Then, when the power of the light source changes, an exposure time is adjusted to correspond to the changed power of the light source (operation S920). Specifically, the exposure time may be adjusted by sensing a variation in a horizontal synchronization signal with respect to a change in a light source and compensating for the sensed variation. More specifically, the difference between before the power of the power source changes and after the power of the power source changes at a falling or rising edge of the horizontal synchronization signal may be calculated, and an exposure time corresponding to before the intensity of light source changes may be adjusted based on the calculated difference.

The adjusting of the exposure time may include detecting a variation in the horizontal synchronization signal corresponding to a voltage applied to a light source unit, based on a lookup table storing variations in the horizontal synchronization signal corresponding to a plurality of voltages applied to the light source unit, and adjusting the exposure time based on the detected variation in the horizontal synchronization signal. In this case, the lookup table may be provided from a manufacturer or may be produced by the image forming apparatus 100 at a predetermined point of time.

When the image forming apparatus 100 produces the lookup table, the lookup table may be produced by sequentially applying different voltages to the light source unit 151 and measuring variations in the horizontal synchronization signal with respect to the different voltages. In this case, when the image forming apparatus 100 is a color image forming apparatus with a plurality of photosensitive media, the power of a second light source that is different from a first light source may be changed while the power of the first light source is fixed among a plurality of light sources, and a change in a time difference between a first horizontal synchronization signal generated from the first light source and a second horizontal synchronization signal generated from the second light source with respect to a change in the power of the second light source may be sensed as a variation in the horizontal synchronization signal with respect to the change in the power of the second power. This process is described above in reference to FIGS. 7 and 8.

After adjusting exposure time in the manner described above, printing is performed based on the adjusted exposure time (operation S930).

Accordingly, in the image forming method according to the present exemplary embodiment of the present general inventive concept, an exposure time may be adjusted according to a change in the power of a light source even when the power of the light source changes, thereby enabling a plurality of colors, which are to be used to form one image, to be printed while being exactly overlapped with one another. The image forming method of FIG. 9 may be performed not only using the image forming apparatus 100 of FIG. 1 but also using an image forming apparatus having a different structure from that of the image forming apparatus 100 of FIG. 1.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include a semiconductor memory, a read-only memory (ROM), a random-access memory (RAM), a USB memory, a memory card, a Blu-Ray disc, CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an image forming unit to perform printing using a light source unit and a photosensitive medium;

a registration unit to adjust an exposure time to correspond to a change in a power of a light source when the power of the light source changes; and a controller to control the image forming unit to perform printing according to the adjusted exposure time, wherein the image forming unit comprises the light source unit including a plurality of light sources, the image forming unit generating a plurality of horizontal synchronization signals to determine the exposure time, wherein the registration unit changes a power of a second light source while a power of a first light source is fixed, and senses a change in a time difference between a first horizontal synchronization signal generated from the first light source and a second horizontal synchronization signal generated from the second light source with respect to a change in the power of the second light source, as a variation in the horizontal synchronization signal.

2. The image forming apparatus of claim 1, wherein:

the registration unit adjusts the exposure time by compensating for the sensed variation.

3. The image forming apparatus of claim 2, wherein:

the image forming unit comprises:

a polygon mirror to cause a light source output from the light source unit to be deflected toward the photosensitive medium by using a plurality of reflection surfaces; and a beam detection sensor which outputs a beam detection signal by sensing the light source reflected from the polygon mirror; and the image forming unit generates the horizontal synchronization signal based on the beam detection signal.

4. The image forming apparatus of claim 1, further comprising:

a storage unit to store variations in a horizontal synchronization signal corresponding to a plurality of voltages applied to the light source unit, in the form of a lookup table, wherein the registration unit detects a variation in the horizontal synchronization signal corresponding to a voltage applied to the light source unit, based on the lookup table, and adjusts the exposure time based on the detected variation in the horizontal synchronization signal.

5. The image forming apparatus of claim 4, wherein the controller sequentially applies different voltages to the light source unit, measures variations in the horizontal synchronization signal with respect to the different voltages, and stores the measured variations in the storage unit.

6. The image forming apparatus of claim 1, wherein:

the image forming unit comprises:

a plurality of photosensitive media, the image forming unit generating the plurality of horizontal synchronization signals corresponding to the plurality of photosensitive media.

7. The image forming apparatus of claim 1, wherein the controller adjusts the power of the light source of the light source unit to correspond to a concentration adjustment process performed to perform printing using a predetermined image concentration by the image forming unit.

8. The image forming apparatus of claim 7, wherein the concentration adjustment process is performed when at least one of temperature and humidity of an ambient environment of the image forming apparatus becomes equal to or greater than a predetermined level, when the image forming unit performs printing a number of times that is equal to or greater than a predetermined number of copies, when the photosensitive medium is replaced with another medium, or when the image forming unit does not perform printing for a predetermined time or more.

9. The image forming apparatus of claim 1, wherein a controller controls a rotation timing of the photosensitive drum according to the power change of the light source unit.

10. An image forming method performed by an image forming apparatus, the method comprising:

sensing a change in a power of a light source of a light source unit;

generating a plurality of horizontal synchronization signals to determine an exposure time;

adjusting the exposure time to correspond to a change in the power of the light source when the power of the light source of the light source unit changes; and performing printing according to the adjusted exposure time, wherein the adjusting of the exposure time comprises:

changing a power of a second light source while a power of a first light source is fixed, sensing a change in a time difference between a first horizontal synchronization signal generated from the first light source and a second horizontal synchronization signal generated from the second light source with respect to a change in the power of the second light source, as a variation in the horizontal synchronization, and adjusting the exposure time to compensate for the sensed variation.

11. The image forming method of claim 10, wherein the adjusting of the exposure time comprises detecting a variation in a horizontal synchronization signal corresponding to a voltage applied to the light source unit, based on a lookup table storing variations in the horizontal synchronization signal corresponding to a plurality of voltages applied to the light source unit, and adjusting the exposure time based on the detected variation in the horizontal synchronization signal.

12. The image forming method of claim 11, further comprising:

generating a lookup table by sequentially applying different voltages to the light source unit and measuring variations in the horizontal synchronization signal with respect to the different voltages.

13. The image forming method of claim 10, wherein generating the plurality of horizontal synchronization signal comprises generating the plurality of horizontal synchronization signals corresponding to a plurality of light sources and a plurality of photosensitive media.

14. The image forming method of claim 10, wherein the sensing of the change in the power of the light source comprises sensing that the power of the light source changes when a concentration adjustment process is performed to perform printing using a predetermined image concentration by the image forming unit.

15. The image forming method of claim 14, wherein the concentration adjustment process is performed when at least one of temperature and humidity of an ambient environment of the image forming apparatus becomes equal to or greater than a predetermined level, when the image forming unit performs printing a number of times that is equal to or greater than a predetermined number of copies, when the photosensitive medium is replaced with another medium, or when the image forming unit does not perform printing for a predetermined time or more.

16. A non-transitory computer readable recording medium to contain computer-readable codes as a program to execute the image forming method of claim 10.

17. The image forming method of claim 10, further comprising:

controlling a rotation timing of the photosensitive drum according to the power change of the light source unit.

* * * * *